US008556396B2

(12) United States Patent
Kato et al.

(10) Patent No.: US 8,556,396 B2
(45) Date of Patent: Oct. 15, 2013

(54) INKJET HEAD AND INKJET RECORDING DEVICE

(75) Inventors: Masaki Kato, Tokyo (JP); Kiyoshi Yamaguchi, Kanagawa (JP); Mitsuru Shingyohuchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/494,162

(22) Filed: Jun. 12, 2012

(65) Prior Publication Data

US 2012/0320131 A1 Dec. 20, 2012

(30) Foreign Application Priority Data

Jun. 17, 2011 (JP) ..... 2011-134828

(51) Int. Cl.
*B41J 2/175* (2006.01)

(52) U.S. Cl.
USPC ..... 347/85

(58) Field of Classification Search
USPC ..... 347/85, 93
See application file for complete search history.

(56) References Cited

U.S. PATENT DOCUMENTS

| | | | | |
|---|---|---|---|---|
| 6,089,701 | A * | 7/2000 | Hashizume et al. | 347/70 |
| 6,491,377 | B1 | 12/2002 | Cleland et al. | |
| 2003/0025769 | A1 | 2/2003 | Shingai et al. | |
| 2008/0007598 | A1 | 1/2008 | Hong et al. | |
| 2012/0069101 | A1 | 3/2012 | Kato et al. | |

FOREIGN PATENT DOCUMENTS

| | | | |
|---|---|---|---|
| EP | 1336487 | * | 2/2003 |
| EP | 1336487 | A2 | 8/2003 |
| JP | 2000-334970 | | 12/2000 |
| JP | 2001-150676 | | 6/2001 |
| JP | 2002-86722 | | 3/2002 |
| JP | 2005-238531 | | 9/2005 |
| JP | 2006-231812 | | 9/2006 |
| JP | 2007-168175 | | 7/2007 |
| JP | 2008-18662 | | 1/2008 |
| JP | 2010-228271 | | 10/2010 |
| JP | 2010-241100 | | 10/2010 |

OTHER PUBLICATIONS

European search report dated Oct. 2, 2012 in connection with corresponding European patent application No. 12171655.9.

* cited by examiner

*Primary Examiner* — Matthew Luu
*Assistant Examiner* — Michael Konczal
(74) *Attorney, Agent, or Firm* — Cooper & Dunham LLP

(57) ABSTRACT

An inkjet head is disclosed, including a nozzle plate, a passage substrate, and a diaphragm. The nozzle plate forms multiple nozzles for discharging ink. A passage substrate joints to the nozzle plate. On the passage substrate, an individual liquid chamber leading to a nozzle, and a liquid supply chamber connected to the individual liquid chamber through an individual passage are formed for each of the multiple nozzles. The diaphragm forms a piezoelectric element which is laminated on a side opposite to the nozzle plate of the passage substrate and includes a lower electrode, a piezoelectric body, and an upper electrode. The liquid supply chamber formed for each of the multiple nozzles is compartmented by a bulkhead from an other liquid supply chamber, and each of the liquid supply chamber and the other liquid supply chamber include multiple ink supply ports.

6 Claims, 9 Drawing Sheets

INKJET HEAD AND INKJET RECORDING DEVICE

BACKGROUND OF THE INVENTION

1. Field of the Invention

The present invention is related to an inkjet head which ejects ink from nozzles, and more particularly to an inkjet head and an inkjet recording device which prevents clogging of the nozzles due to foreign materials in the ink, foreign materials attached in a fabrication process, and the like.

2. Description of the Related Art

Recently, in response to a request of higher quality for an image forming apparatus, technologies related to a higher resolution of an inkjet printer, a laser printer, and the like have been developed.

Especially, in a case of realizing the higher resolution for the inkjet printer, a higher density of the nozzles and finer liquid droplets are fundamental for the inkjet head. Thus, a smaller nozzle diameter for discharging the ink and a higher integration of the nozzles has been attempted.

Conventionally, in the inkjet head, clogging of the nozzles occurs due to the foreign materials included in the ink, aggregates caused by ink components, and the like. In a case of enhancing fining of the nozzle diameter as described above, an allowable size of the foreign material is reduced. Thus, there is a problem in which clogging occurrences of the nozzles are increased if the fining of the nozzle diameters is performed.

There are foreign materials causing clogging of the nozzles, other than materials originated in the ink itself, adhere to an ink passage in a fabrication process of the inkjet head. In the fabrication process of the inkjet head, each of parts is cleaned, and then is built under a clean environment (a clean booth, a clean room, and the like) which is highly maintained. Accordingly, it is not possible to completely prevent the foreign materials from adhering to the nozzles.

It may be possible to reduce the foreign materials and aggregates included in the ink by improving the ink parts and providing a filter. However, it is difficult to prevent clogging caused by the foreign materials adhering to a vicinity of the nozzles in the fabrication process.

Thus, it may be considered to form the filter for eliminating the foreign materials at the nearest location possible to the nozzles in a fabrication process of the parts, and to prevent an occurrence of clogging caused by the foreign materials adhering to the nozzles in a subsequent fabrication process.

However, in a case of forming the filter in the fabrication process of the parts for manufacturing the inkjet head, fabrication costs may increase.

For example, the nozzle diameter of a recent inkjet head for discharging droplets of a few pico liters is 10 μm to 20 μm. Thus, a high-precision process may be required to make an opening diameter of the filter for eliminating the foreign materials less than or equal to 10 μm. Also, a filter having a single thin layer is required to be formed at the parts. Thus, a micro fabrication is carried out to form an opening diameter of approximately 10 μm.

As above-described methods for the micro fabrication of the filter, an etching method using a photo-lithography, electroforming method, and the like are known. In any case, it is difficult to suppress an increase of the fabrication costs.

Moreover, due to the fining of the nozzle diameter and the higher density of the nozzles, an engineering development for fining an actuator or the like, which pressurizes a liquid chamber leading to the nozzles, has been advanced. Specifically, a Micro Electro Mechanical Systems (MEMS) technology using a semiconductor process technology has been deployed for the inkjet head. By using the MEMS technology, it is possible to form a diaphragm, a liquid chamber, an ink passage, an actuator, an electrode, and the like on a silicon wafer. It is also possible to micronize the nozzles, and the liquid chamber, and the like.

However, materials, which can be used as structural components such as the diaphragm, the filter, and the like in the MEMS technology, may be limited to materials made from a Chemical Vapor Deposition (CVD) such as $Si_3N_4$, $SiO_2$, p-Si, and the like. For metal and alloy materials, a sputtering method, a vapor-deposition method, and the like are used as a film forming method. Accordingly, it is difficult to form compact films to be the structural components.

Alternatively, a photosensitive resin material such as a dry film resist, and the like, may be used as the structural components. It is required to make the film thicker in order to ensure stiffness of the film. As a result, a resolution is decreased. Moreover, it is difficult to form electrodes and the like on a resin material in terms of moisture resistance, surface properties, and the like. This method has limited application.

Accordingly, as a material used to form the compact filter by using the MEMS technology, an inorganic material such as silicon nitride may be used. However, the inorganic material is stiff, and has a sufficient internal stress. Thus, the inorganic material includes risks of deformation and damage due to an occurrence of cracks or the like.

In order to solve the above described problems, for example, Japanese Laid-open Patent Application No. 2008-18662 discloses a technology related to a liquid droplet jet apparatus which includes a channel unit which includes a liquid passage including a nozzle for discharging a droplet, an energy applying unit which applies energy to liquid in the liquid passage to discharge the liquid, and a laminated body which is formed by layering multiple plates and includes a filter for eliminating the foreign materials in the liquid supplied to the liquid passage.

In the liquid droplet jet apparatus according to Japanese Laid-open Patent Application No. 2008-18662, multiple through-holes passing through to the liquid passage are formed for each of the multiple plates, and the multiple plates are layered so that the through-holes for each of the multiple plates are partially overlapped. By this configuration, it is possible to supply the liquid, in which fine foreign materials are also eliminated, and to prevent the nozzles from being clogged. Moreover, since the multiple plates are layered, it is possible to suppress the increase of the fabrication costs to form the filter.

However, in the liquid droplet jet apparatus according to Japanese Laid-open Patent Application No. 2008-18662, dispersion of a size of the through-hole to be the filter is caused by micro deviation of layering the multiple plates. Thus, there is a problem in which the foreign materials are not effectively eliminated. Moreover, the plates, in which the multiple through-holes are formed, may be deformed and damaged by a load driving a piezoelectric actuator corresponding to the energy applying unit. Furthermore, the number of parts increase to form the filter by the multiple plates, and it is inevitable to increase the fabrication costs.

SUMMARY OF THE INVENTION

The present invention solves or reduces one or more of the above problems.

In one aspect of this disclosure, there is provided an inkjet head, including a nozzle plate configured to form multiple nozzles for discharging ink; a passage substrate configured to be jointed to the nozzle plate, and in which an individual liquid chamber leading to a nozzle, and a liquid supply chamber connected to the individual liquid chamber through an individual passage are formed for each of the multiple nozzles; and a diaphragm configured to form a piezoelectric element which is laminated on a side opposite to the nozzle plate of the passage substrate and includes a lower electrode, a piezoelectric body, and an upper electrode, wherein the liquid supply chamber formed for each of the multiple nozzles is compartmented by a bulkhead from an other liquid supply chamber, and each of the liquid supply chamber and the other liquid supply chamber includes multiple ink supply ports.

BRIEF DESCRIPTION OF THE DRAWINGS

In the following, embodiments of the present invention will be described with reference to the accompanying drawings.

DESCRIPTION OF THE PREFERRED EMBODIMENTS

In the following, an embodiment according to the present invention will be described with reference to the accompanying drawings.

First Embodiment

A configuration of an inkjet head 100 according to a first embodiment will be illustrated in FIG. 1 through FIG. 4.

Figure 1:
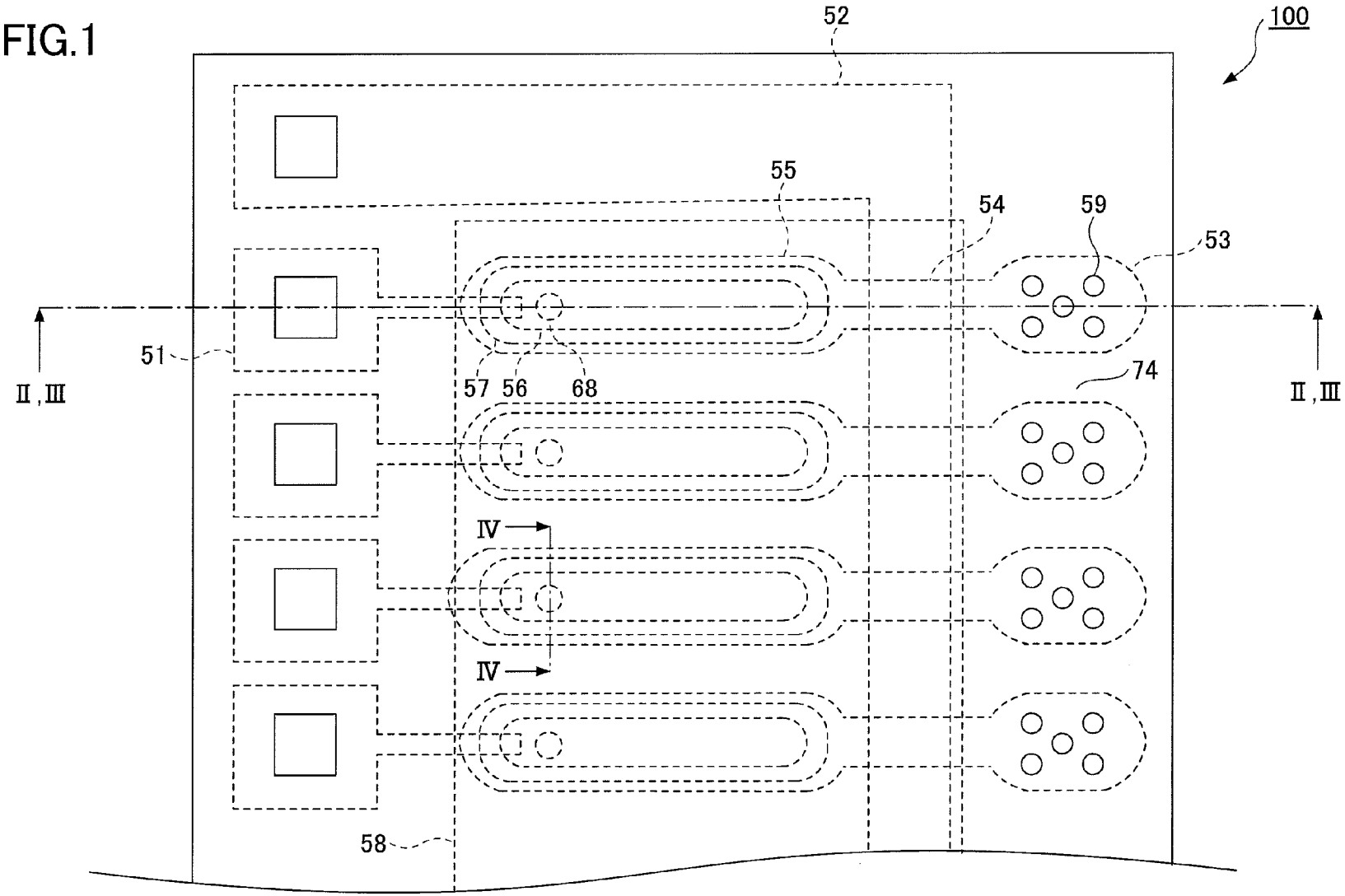
FIG. 1 is a schematic top view of an inkjet head according to a first embodiment.
Figure 2:
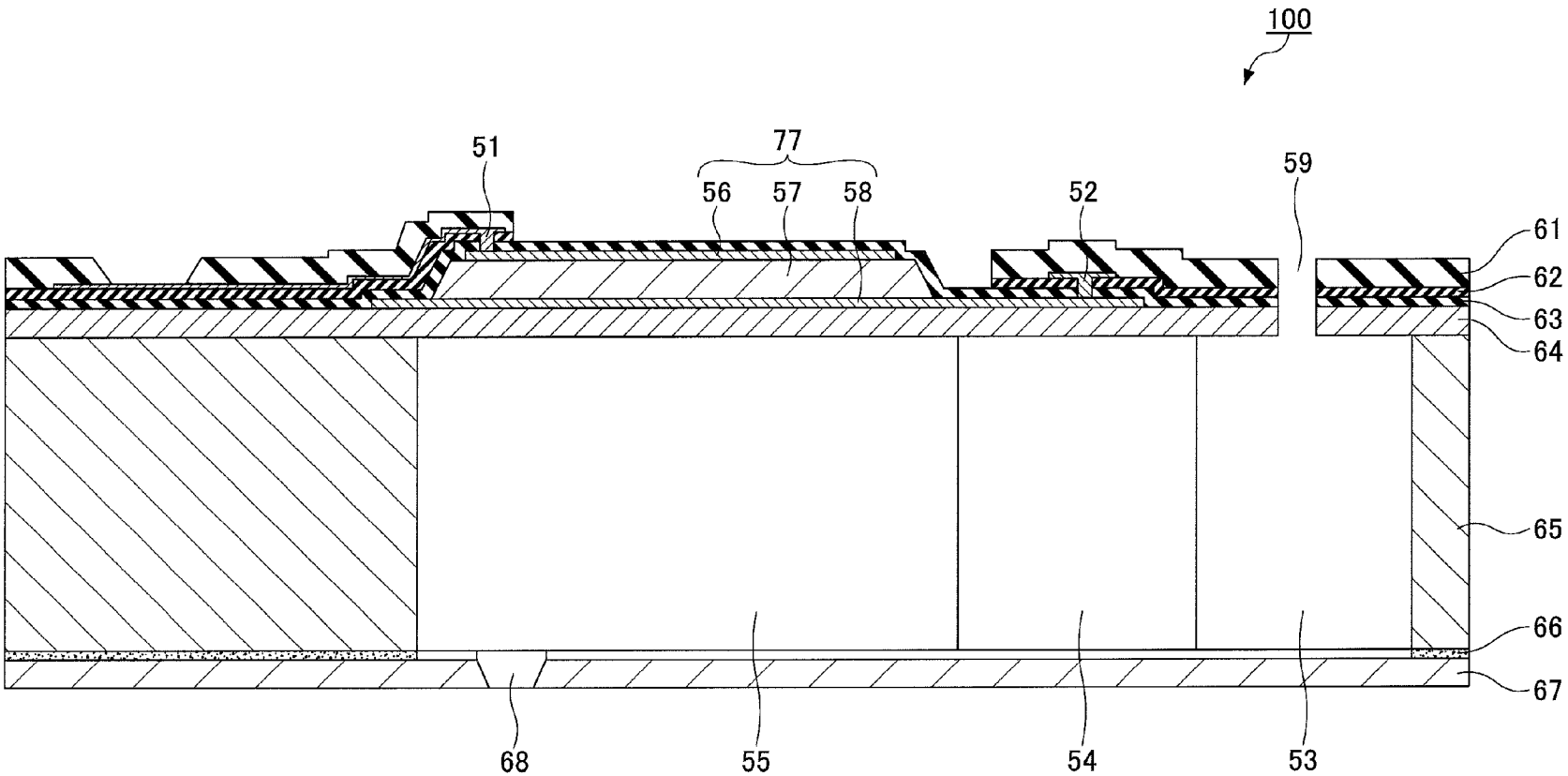
FIG. 2 is a cross sectional view of the inkjet head according to the first embodiment illustrated in FIG. 1.
Figure 3:
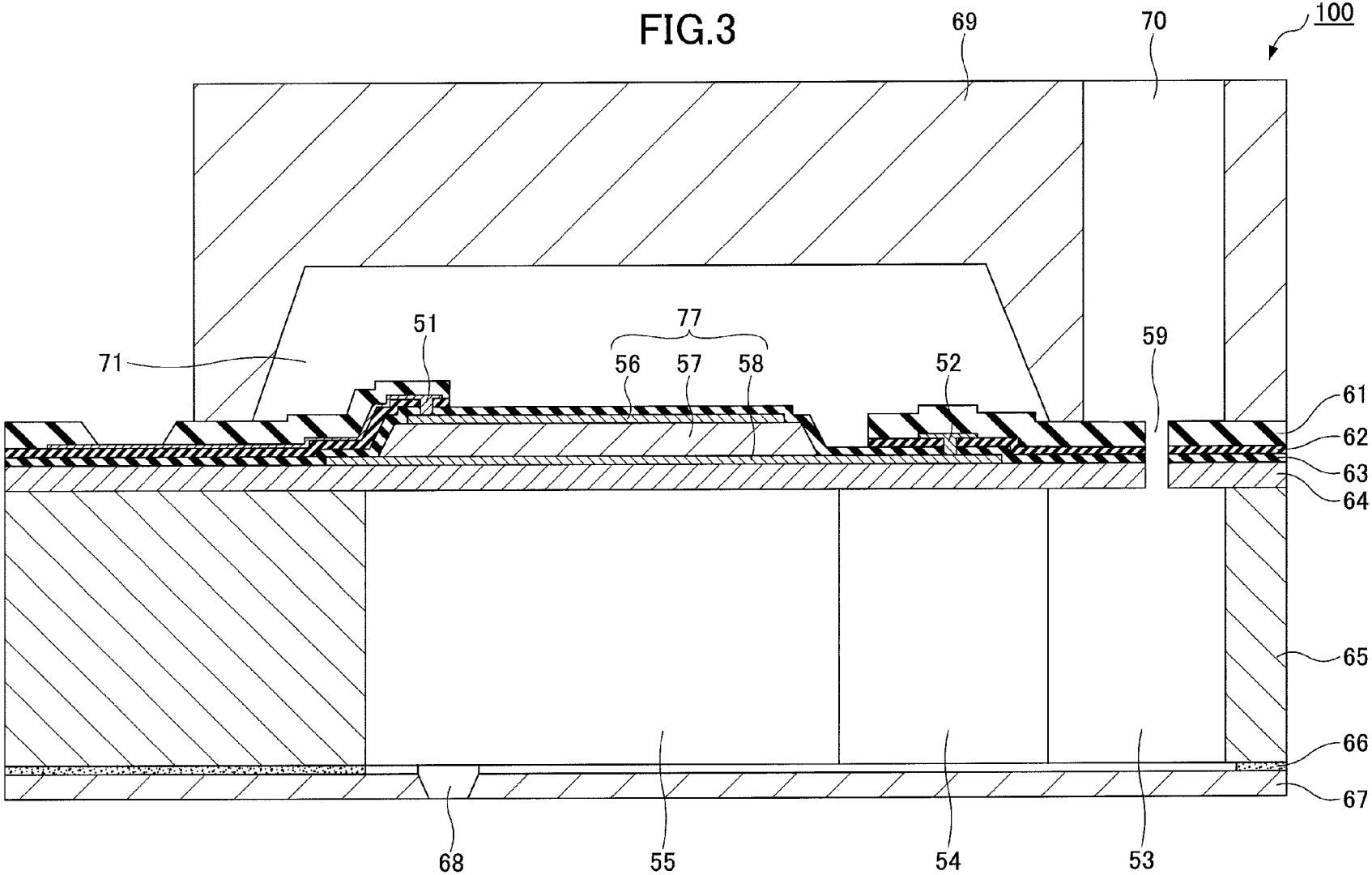
FIG. 3 is a cross sectional view of the inkjet head to which a retention substrate according to the first embodiment illustrated in FIG. 1 is jointed.
Figure 4:
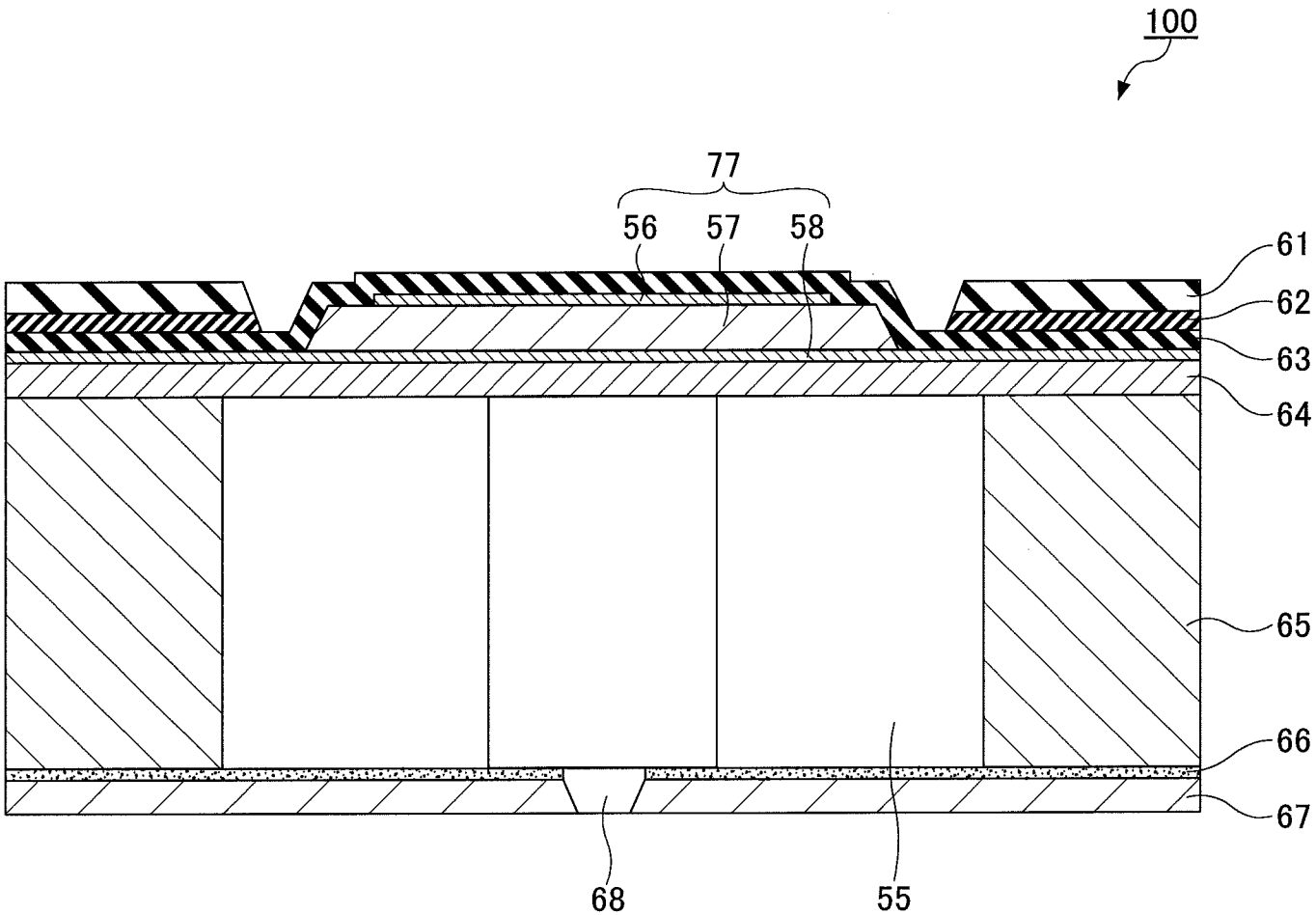
FIG. 4 is a cross sectional view of the inkjet head according to the first embodiment illustrated in FIG. 1.

FIG. 1 is a schematic top view in which the inkjet head 100 according to the first embodiment is partially enlarged. FIG. 2 through FIG. 4 are cross sectional views of the top surface by a line II-II, a line III-III, and a line IV-IV in FIG. 1.

<Outline of Configuration of Inkjet Head>

As illustrated in FIG. 2, on a passage substrate 65 in which an ink passage leading to a nozzle 68 is formed, an individual liquid chamber 55 leading to the nozzle 68, and an ink supply chamber 53 connected to the individual liquid chamber 55 through an individual passage 54 are formed.

One surface of the passage substrate 65 is jointed by an adhesive layer 66 to a nozzle plate 67 on which the nozzle 68 is formed, and a diaphragm 64 is layered onto another surface of the passage substrate 65.

On the diaphragm 64, at a location corresponding to the individual liquid chamber 55, a piezoelectric element 77 is formed by a lower electrode 58, a piezoelectric body 57, and an upper electrode 56. By driving the piezoelectric element 77, an ink pressure is fluctuated in the individual liquid chamber 55, and ink is ejected from the nozzle 68.

An amount of ink equaling that ejected from the nozzle 68 is supplied to the individual liquid chamber 55, and the ink is ejected repeatedly from the nozzle 68.

<Nozzle Plate>

A plurality of the nozzles 68 for discharging the ink are formed on the nozzle plate 67. As illustrated in FIG. 1, the individual liquid chamber 55, the individual passage 54, and the ink supply chamber 53 are formed for each of the nozzles 68. The nozzles 68 are arranged in an array or a matrix on the nozzle plate 67.

The nozzle 68 may be arranged at any location. By arranging the nozzle 68 on aside opposite to an ink supply side at an edge of the individual liquid chamber 55, it is possible to acquire a high ejection efficiency with respect to pressure.

It is required to design the nozzles 68 with the most appropriate arrangement and density from a desired image resolution, an image formation speed, and the like in a case of the inkjet head 100 used for an image forming apparatus.

An appropriate material quality may be selected from processability, productivity, and physical properties (rigidity, chemical resistance, and the like) for the nozzles 68. For example, metal and alloyed metal such as Austenitic Stainless Steel (SUS), Ni alloy, and the like, resin materials such as polyimide, dry film resist, and the like, inorganic materials such as Si, glass, and the like may be used.

Moreover, it is required to appropriately select the material quality in accordance with a nozzle process method. In a case of performing a nozzle formation by a pressing process, the metal and the alloyed metal may be used. The metal or the alloyed metal such as Ni or the like which can be electrocasted is suitable for a case of forming the nozzle 68 by electrocasting. A resin material is suitable for a laser process. A photosensitive resin (dry film resist and the like) and Si are suitable for a case of using photolithography.

A diameter of the nozzle 68 may be designed to be suitable for ejection performance and the physical properties of the ink to be ejected. The diameter is generally designed to be approximately Φ10 μm to Φ40 μm. Any shape may be formed for the nozzle 68. However, a true round shape is preferable since a straight advancing property of the liquid droplet becomes favorable. In a cross-sectional structure, a shape may be selected from a straight shape, a tapered shape, a round shape (R is applied), and the like based on a desired ejection performance.

The nozzle plate 67 and the passage substrate 65 are jointed by any method. In general, a joint method using an adhesive agent is used.

<Passage Substrate>

A wafer which is made from Si or includes Si as a primary component for the passage substrate 65. By using a Si wafer, it is possible to perform a micro-fabrication using a MEMS method such as a photolithography method, an etching method, and the like. Any of an anisotropic etching with alkaline liquid, an Inductively Coupled Plasma (ICP) dry etching using Bosch process, and the like may be applied as the etching method.

In a case of using the anisotropic etchings, since a processed surface is limited to a (111) crystal face of the Si wafer, a design flexibility of a liquid chamber and a passage substrate may be greatly degraded. On the other hand, there is no restriction in the dry etching method for the (111) crystal face. Thus, since it is possible to improve the design flexibility, the dry etching method may be preferable.

The individual liquid chamber 55, the individual passage 54, and the ink supply chamber 53 are formed on the passage substrate 65 to lead to the nozzle 68. Also, the individual liquid chamber 55, the individual passage 54, and the ink supply chamber 53 are formed for each of the multiple nozzles 68.

The individual liquid chamber 55 includes a function for maintaining the ink to be ejected from the nozzle 68 and for discharging an ink droplet from the nozzle 68 in response to a change of an internal pressure by driving the piezoelectric element 77 which is described later. For the individual liquid chamber 55, a shape having high ejection efficiency is preferable, and may be formed to have desired ejection efficiency corresponding to the desired ejection performance.

The individual passage 54 includes a function for supplying the ink to the individual liquid chamber 55. Also, the individual passage 54 includes a function improving fluid resistance by making width and height thereof lower than those of the individual liquid chamber 55. By this configuration, it is possible to change pressure of the individual liquid chamber 55, to adjust an ink supply amount in response to an ejection amount from the nozzle 68, and to alleviate pressure vibration in the individual liquid chamber 55.

The ink is supplied to the ink supply chamber 53 from an ink supply port 59 which will be described later, and is formed to lead to the individual liquid chamber 55 through the individual passage 54. Configurations of the ink supply chamber 53 and the ink supply port 59, a filter function of the ink supply port 59, and the like will be described later.

<Diaphragm>

As illustrated in FIG. 2, at an opposite side of the nozzle plate 67 of the passage substrate 65, the diaphragm 64 is layered, so that at least the individual liquid chamber 55, the individual passage 54, and one side of an ink passage formation part of the ink supply chamber 53 are coated and formed.

The diaphragm 64 includes a function for sealing a side opposed to the nozzle plate 67 of the passage substrate 65, and for generating a volume change of the individual liquid chamber 55 by displacing a portion corresponding to the individual liquid chamber 55 by the piezoelectric element 77.

Moreover, in a case of forming the individual liquid chamber 55, the individual passage 54, and the ink supply chamber 53 by etching, an etching stop layer may be formed on the diaphragm 64 by using material having a different etching rate from that of material of the passage substrate 65.

It is possible to form the diaphragm 64 by using any material. In the first embodiment, it is possible to perform the micro-fabrication by an MEMS fabrication process. Accordingly, it is preferable to use a semiconductor or an insulator used in a semiconductor fabrication process.

As these materials, Si, polycrystal Si, amorphous Si, SiO2, and Si3N4 may be used. In a case of using these materials, it is possible to use a film formation apparatus (CVD, diffusion furnace, and the like) generally used in the semiconductor fabrication process. Thus, advantageously, it is possible to carry out the micro-fabrication by using a stable existing fabrication technology.

Also, as a laminated structure of these materials, it is possible to form a configuration which reduces the internal stress. In a case of forming a film with the above-described materials by the CVD, it is possible to make a neutral configuration as a whole of the diaphragm 64 by laminating multiple layers of SiO2 having compression stress and Si3N4 having tensile stress. The number of layers is appropriately determined based on a required film thickness. A range of three to ten layers is preferable. If the number of layers is fewer, a residual stress is occurred due to dispersion of the film thickness. If the number of layers is greater, the productivity is degraded.

The diaphragm 64 may be formed in adequate thickness based on the physical properties and the productivity of the diaphragm 64. It is preferable to form the diaphragm 64 in a range of thickness from 1 μm to 10 μm.

In a case of thinning the diaphragm 64, since stiffness of the diaphragm 64 is degraded, the diaphragm 64 is easily displaced by a drive of the piezoelectric element 77. On the other hand, since the pressure is not easily raised even if the piezoelectric element 77 is driven, the ejection performance is degraded, in addition to being easily influenced from the ink pressure in the individual liquid chamber 55.

In a case of making the diaphragm 64 thicker, the influence of the above-described pressure is reduced. On the other hand, since the stiffness of the diaphragm 64 becomes higher, it becomes necessary to improve a driving voltage and performance of the piezoelectric element 77 to ensure a vibratory displacement. Accordingly, it is required to form the diaphragm 64 in adequate thickness based on the performance and a drive condition of the piezoelectric element 77.

Moreover, if the stiffness of the diaphragm 64 is changed depending on the thickness or the material of the diaphragm 64, a Helmholtz period is changed in the individual liquid chamber 55 including ink fluid. It is required to make an ejection period of the ink longer than the Helmholtz period. Thus, in a case of ejecting the ink at high speed (short period), it is required to select the thickness and the material including the Helmholtz period for the most appropriate diaphragm 64. By making the diaphragm 64 have higher stiffness, the Helmholtz period can be shorter. Since the above-described ejection performance is influenced, it is required to optimize the diaphragm 64 in response to a desired feature.

<Piezoelectric Element>

As illustrated in FIG. 1 through FIG. 4, the piezoelectric element 77 is formed at a location corresponding to the individual liquid chamber 55 of the diaphragm 64, and includes the lower electrode 58, the piezoelectric body 57, and the upper electrode 56. The piezoelectric element 77 is regarded as an electromechanical conversion element which is transformed by a voltage applied between the upper electrode 56 and the lower electrode 58.

Any material may be used for the piezoelectric body 57. Lead zirconate titanate, barium titanate, and materials derived from these materials are generally used as the piezoelectric body. For the inkjet head 100 according to the first embodiment, lead zirconate titanate may be used because of its temperature stability and chemical stability.

The piezoelectric element 77 may be formed in an adequate thickness based on a physical property (piezoelectric constant) of the piezoelectric body 57 and the desired displacement amount. It is preferable to form the piezoelectric element 77 in a range from 0.5 μm to 10 μm. In a case in which the thickness is too thin, since a high electric field is applied when a voltage is applied, a withstand-voltage failure and the like may easily occur. In a case in which the thickness is too thick, since it is required to raise voltage applied to displace, loads such as a driving circuit and the like become higher. Similar to the thickness of the diaphragm 64 described above, the thickness of the piezoelectric body 57 influences the Helmholtz period. Thus, it is required to optimize the thickness by corresponding to the ejection performance.

As materials of the lower electrode 58 and the upper electrode 56, any conductive material may be used. The material is required to have heat resistance of approximately 700° C. which is the sintering temperature of the piezoelectric body 57. That is, it is required to select the material which does not chemically react at high temperature with material forming the piezoelectric body 57.

As the above-described material, for example, metal, alloyed metal, conductive compound, and the like having high heat resistance may be used. As the metal, noble metals of Au, Pt, Ir, Pd, and, alloyed metal and oxide in which these noble metals are used as primary components. Conductive oxide may be used as the conductive compound.

It is possible to form an electrode in any film thickness. A range from 50 nm to 1000 nm is preferable. Moreover, it is possible to reduce the residual stress and to improve adhesion by forming a laminated structure with these electrode materials.

The lower electrode 58 is required to be formed at a location corresponding to the individual liquid chamber 55 at least. Since the lower electrode 58 is not formed for each of the individual liquid chambers 55, the lower electrode 58 may be formed to cover a plurality of the individual liquid chambers 55 as illustrated in FIG. 1. The piezoelectric body 57 and the upper electrode 56 are required to be formed for each of the individual liquid chambers 55. It is possible to discharge the ink from any nozzles 68 by applying voltage to the upper electrode 56 at a location where the ink is discharged.

A formation area of the piezoelectric body 57 is required to be formed inside a wall side of the individual liquid chamber 55, as illustrated in FIG. 1 and FIG. 4. It is possible to increase a displacement amount of the diaphragm 64 by this configuration.

<Insulation Film and Wiring Electrode>

In order to protect an edge of the piezoelectric element 77 from damage in the fabrication process, moisture in the air, and the like, an insulation film 63 may cover an area including the edge of the piezoelectric body 57. It is possible to improve an environmental resistance and reliability of the piezoelectric element by using the insulation film 63.

Any material, film thickness, and film formation method may be used for the insulation film 63. As the material, it is preferable to use inorganic material, for example, insulation material such as metal oxide, metal nitride, and the like. Also, film thickness is preferably formed thinner so as not to inhibit an oscillation and a displacement in a range ensuring a protection function. A film thickness less than or equal to 100 nm is preferable.

In order to apply an electronic signal to the upper electrode 56 and the lower electrode 58 which form the piezoelectric element 77, a wiring is formed from each of electrodes to a signal input part. As illustrated in the schematic top view in FIG. 1 and the cross sectional view in FIG. 2, an individual wiring electrode 51 is connected from the upper electrode 56 to a drive circuit (not illustrated), and a common electrode wiring 52 is connected from the lower electrode 58 to the drive circuit.

An insulation film 62 including a function of an inter-layer insulation film is formed to lead out these wiring electrodes from the upper electrode 56 and the lower electrode 58. The individual wiring electrode 51 and the upper electrode 56 are connected to each other through a contact hole which is formed to penetrate the insulation film 62 and the insulation film 63. The common electrode wiring 52 and the lower electrode 58 may be formed to connect to each other at any location. In the first embodiment, the common electrode wiring 52 and the lower electrode 58 are formed at a location corresponding to the individual passage 54.

Similar to the first embodiment, in a case in which the common electrode wiring 52 and the lower electrode 58 are connected to each other at the location corresponding to the individual passage 54, the lower electrode 58 is extended to the individual passage 54, and a common electrode contact hole is formed in the insulation film 62 and the insulation film 63.

By providing the common electrode contact hole, it is possible to improve connection reliability. In addition, in a case of arranging a plurality of the individual liquid chambers 55 in parallel as illustrated in FIG. 1, it is possible to reduce voltage drop due to an electrode resistance value at a lower part and to improve uniformity of the ejection performance.

Any insulation material may be used for the insulation film 62. It is preferable to use insulation material generally used for a semiconductor, since a micro-structural formation can be realized by ensuring the productivity and concurrently utilizing an existing technology.

Also, inorganic insulation material, resin, and the like may be used. Since the above-described existing technology may be utilized, it is preferable to use the inorganic insulation material used in the semiconductor fabrication process. For example, it is possible to use $SiO_2$ and $Si_3N_4$, which can be formed by the CVD, as the inorganic insulation material, poly-para-xylylene, polyimide, and the like as resin, and the like.

The film thickness of the insulation film 62 is required to have a sufficient insulation property and pressure resistance with respect to voltage applied to the lower electrode 58 and the upper electrode 56. In a case of using $SiO_2$, it is preferable to form the film thickness greater than or equal to 0.2 μm.

It is required to use conductive material, in which a contact resistance is sufficiently low to the upper electrode 56 and the lower electrode 58 and a resistance value is low, for the individual wiring electrode 51 and the common electrode wiring 52. The material may be selected from metal, alloyed metal, and a conductive compound. In light of the resistance value, it is preferable to use the metal or alloyed material.

As examples of these materials, Au, Ag, Cu, Al, W, Ta, and the like may be used. Material, in which any element is added to these materials, may be used as an alloy. The film thickness may be determined based on the resistance value.

In a case of using material, which is easily corroded such as Al, Al alloy, or the like, for the individual wiring electrode 51 and the common electrode wiring 52, an insulation film 61 is formed as a wiring passivation layer. It is required to coat an area excluding a drive circuit connection part of the individual wiring electrode 51 and the common electrode wiring 52 with the insulation film 61.

As material of the insulation film 61, any material may be used if the material is an insulation material to be the wiring passivation. For example, inorganic material such as oxide, nitride, carbide, or the like, or a resin may be used. In light of corrosion protection of wiring, the inorganic material is preferable due to air permeability, and moisture permeability. For example, materials such as $SiO_2$, $Si_3N_4$, SiC, $Al_2O_3$, $XrO_2$, $TiO_2$, $Ta_2O_5$, and the like may be used. As a general passivation material, $Si_3N_4$ may be preferable.

Each of the insulation films 61, 62, and 63 may be formed on areas other than the above-described area. Especially, it is possible to improve strength of the diaphragm 64 by forming an insulation film on portions corresponding to the individual passage 54 and the ink supply chamber 53 of the diaphragm 64.

The insulation film is formed in this manner, and the diaphragm 64 of a portion corresponding to the individual passage 54 and the ink supply chamber is strengthened, thereby it becomes possible to stabilize discharge performance. Also, it is preferable to eliminate a peripheral portion of the piezoelectric element 77 on the insulation films 61 and 62. By eliminating the insulation film of the piezoelectric element 77 and the peripheral portion, it is possible to increase the vibratory displacement and to improve discharge efficiency.

<Retention Substrate, Common Liquid Chamber, Vibration Chamber>

The inkjet head 100 according to the present invention is formed by jointing a retention substrate 69 including a common liquid chamber 70 to a side of the diaphragm 64 of the passage substrate 65. FIG. 3 illustrates a sectional view of a state of jointing the retention substrate 69 in the inkjet head 100 according to the first embodiment.

The retention substrate 69 is connected to an ink tank (not depicted), and supplies the ink to the ink supply chamber 53 of the passage substrate 65 through the common liquid chamber 70 formed in the retention substrate 69.

Moreover, a vibration chamber 71 is formed in an area corresponding to the piezoelectric element 77 on the diaphragm 64. The vibration chamber 71 is required to acquire an area where the piezoelectric element 77 is displaced. It is required to provide an opening part at a portion connecting the individual wiring electrode 51 and the common electrode wiring 52 with a drive circuit.

The vibration chamber 71 may be formed for each of the individual liquid chambers 55, and may be formed so as to include the multiple individual liquid chambers 55. Since strength of the passage substrate 65 may be improved and mutual interference from an adjacent individual liquid chamber 55 may be reduced. Thus, it is possible to form the vibration chamber 71 for each of the individual liquid chambers 55.

The retention substrate 69 is jointed to a portion contacting the insulation film 61 on the diaphragm 64 other than opening parts such as the common liquid chamber 70 and the vibration chamber 71.

Though any joint method may be used, it is preferable to use an adhesion bond. Especially, since a joint portion of the passage substrate 65 to the retention substrate 69 around the ink supply port 59 contacts the ink passage, it is required to apply the joint method capable of sealing the ink. It is preferable to joint the retention substrate 69 by using the adhesion bond capable of complementing roughness of a surface of the junction interface.

<Ink Supply Chamber and Ink Supply Port>

Next, the ink supply chamber 53, and the ink supply port 59 will be described.

In the inkjet head 100 according to the embodiment, as illustrated in FIG. 1, multiple ink supply ports 59 are formed for each of the ink supply chambers 53. In the first embodiment, five ink supply ports 59 are formed for each of the ink supply chambers 53.

The ink supply ports 59 functions as a filter which prevents the nozzle 68 from being clogged due to the foreign materials and the like included in the ink which enters the individual liquid chamber 55.

The diaphragm 64, where the ink supply port 59 is formed, is formed at a pre-stage of a processing process of the passage substrate 65 which will be described later. Accordingly, only two paths, the nozzle 68 and the ink supply ports 59, exist for the individual liquid chamber 55 to contact outside at a stage after the nozzle plate 67 is jointed. Therefore, by forming an opening diameter of the ink supply port 59 smaller than a diameter of the nozzle 68, it is possible to prevent foreign material of which the diameter is wider than the nozzle diameter from entering the ink passage in the individual liquid chamber 55 at an earlier stage of the fabrication process.

A shape of the ink supply port 59 may be formed arbitrarily. However, it is preferable to form the ink supply port 59 to be the same shape as that of the nozzle 68, and it is required to form an opening diameter of the ink supply port 59 to be smaller than the diameter of the nozzle 68. In a case in which the diameter of the ink supply port 59 is wider than that of the nozzle 68, the foreign material having a diameter wider than the nozzle diameter mixes in the individual liquid chamber 55, and it is difficult to effectively prevent an occurrence of clogging of the nozzle 68.

Moreover, in a case of in which the diameter of the ink supply port 59 is smaller than that of the nozzle 68, a fluid resistance value becomes higher at the ink supply port 59. Accordingly, in order to assure the ink supply amount corresponding to the ink discharge amount, it is preferable to form a plurality of the ink supply ports 59 for each of the ink supply chambers 53.

It is also preferable to make the fluid resistance value at the ink supply port 59 lower than that of the individual passage 54. Furthermore, it is preferable to make the fluid resistance value at the ink supply port 59 half that at the individual passage 54. Therefore, it is required to form a plurality of the ink supply ports 59 for each of the plurality of the ink supply chambers 53. A necessary number of the ink supply ports 59 may be designed based on the above-described fluid resistance value.

The ink supply ports 59 having a filter function according to the first embodiment are formed on the diaphragm 64 without an additional member. It is possible to form the ink supply ports 59 without increasing the fabrication cost.

Moreover, as illustrated in FIG. 1, each of the ink supply chambers 53 is compartmented with a bulkhead 74 from other ink supply chambers 53. By this configuration, it is possible to strengthen the diaphragm 64, which is a thin film on which the ink supply ports 59 are formed, with the bulkhead 74 of the ink supply chamber 53. Especially, it is possible to assure the strength of a portion where the ink supply ports 59 of the diaphragm 64 are formed.

Materials such as Si, SiO2, Si3N4, and the like used for the diaphragm 64 according to the first embodiment are hard, have brittleness, and possess residual stress. Thus, in a case of a structure in which a portion where the ink supply ports 59 of the passage substrate 65 are widely opened, cracks may easily occur.

However, in the inkjet head 100 according to the first embodiment, the bulkhead 74 is formed to compartment each of the ink supply chambers 53 at portions corresponding to the ink supply ports 59 of the diaphragm 64. It is possible to prevent an occurrence of the above-described cracks.

Furthermore, by compartmenting each of the ink supply chambers 53 with the bulkhead 74, compared to a case in which the bulkhead 74 is not provided, it is possible to make a difference between the opening areas smaller in a case of viewing from a top side of the individual passages 54 and the individual liquid chambers 55.

In a case of forming the passage substrate 65 by etching, an etching rate becomes different depending on the opening area. If a different between an opening area for the individual passages 54 and an opening area for the individual liquid chambers 55 is greater, a measurement accuracy becomes degraded.

For example, in a case in which the etching rate of the ink supply chambers 53 having a wide opening area is high, when the individual passages 54 having a small opening area are formed by etching, an overetching is performed for the ink supply chambers 53. As a result, the overetching is also conducted for a portion where the ink supply port 59 is formed. The opening diameters of the ink supply ports 59 functioning as the filter are dispersed, and the ink supply ports 59 may not function as the filter. Moreover, since a bulkhead portion in the ink passage is etched, it may be of concern that the measurement accuracy of the individual passages 54 forming the fluid resistance part is degraded.

In the inkjet head 100 according to the first embodiment, the ink supply chambers 53 are individually compartmented by the bulkhead 74, and each difference of the opening areas respective to the ink supply chamber 53, the individual passage 54, and the individual liquid chamber 55 is made to be smaller. Thus, it is possible to prevent an occurrence of the overetching, and to realize a highly accurate process.

Moreover, the above-described insulation films may be laminated on portions where the ink supply ports 59 of the diaphragm 64 are formed. In the first embodiment, the insulation films are laminated on the portions where the ink supply ports 59 of the diaphragm 64 are formed.

The insulation films are regarded as films necessary to demonstrate functions such as piezoelectric protection, interlayer insulation, wiring protection, and the like, and any of the insulation films is of a higher strength and is a denser film. By laminating higher strength and denser films on the portions where the ink supply ports 59 of the diaphragm 64, it is possible to further improve the strength of peripheral parts of the ink supply ports 59 of the diaphragm 64.

By improving the strength, it is possible to make narrower intervals to form the ink supply ports 59, and to reduce fluid resistance values at the plurality of the ink supply ports 59 leading to the ink supply chambers 53. Accordingly, it is possible to further minimize the head by reducing areas of the ink supply chambers 53. It is possible to realize laminating the insulation films around the ink supply ports 59 without an additional layer and an additional process. The above-described effects can be acquired without losing productivity.

<Production Method>

FIG. 6A through FIG. 6F illustrate a diagrams for explaining an example of the fabrication method of the inkjet head 100 according to the first embodiment.

Figure 6A:
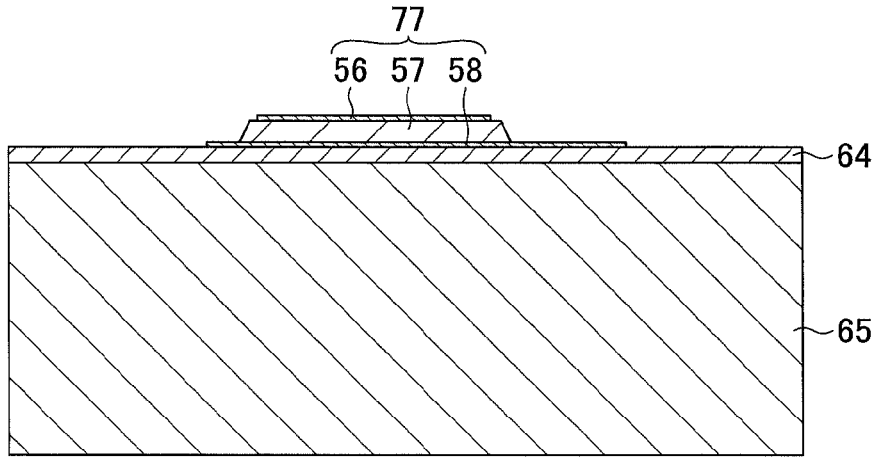
FIG. 6A through FIG. 6F are diagrams for explaining an example of a fabrication method of the inkjet head according to the first embodiment.

FIG. 6A is a diagram illustrating a process for forming the diaphragm 64 and the piezoelectric element 77 on the passage substrate 65.

First, the diaphragm 64 is formed on the passage substrate 65 of a Si wafer. A general material, which is formed as the film in a semiconductor fabrication process such as Si, SiO2, Si3N4, and the like, may be used. When a film quality is considered for a film formation method, it is preferable to use a LP-CVD method. Alternatively, a plasma CVD method, a thermally-oxidized film, or the like may be combined with the LP-CVD method.

Next, the lower electrode 58 is formed on the diaphragm 64 being formed. The lower electrode 58 is formed by the film formation method of general electrode material such as a sputtering method or the like and is patterned by photolithography and etching. For the piezoelectric body 57 on the lower electrode 58, the sputtering method, and a sol-gel method, which bakes an organic metal solution by coating and drying, may be used. However, in a case of forming the film thickness of the piezoelectric body 57 to be greater than or equal to 1000 nm, since a film formation rate is low and the productivity is degraded in the sputtering method, the sol-gel method having a higher productivity may be preferable.

After a film formation is performed to form the piezoelectric body 57, a baking process is carried out to crystallize the piezoelectric body 57. In a case of lead zirconate titanate being a general piezoelectric body, a sintering temperature is approximately 700 degrees.

Before the piezoelectric body 57 is patterned, the upper electrode 56 is formed and patterned. Hence, in a case in which the film thickness of the piezoelectric body 57 is greater than or equal to 1 μm, an etching residual of the upper electrode 56 remains at an edge of the piezoelectric body 57, and it is possible to reduce occurrences of leaking or shorting between the upper electrode 56 and the lower electrode 58.

It is possible to use the same method for patterning the upper electrode 56 and the lower electrode 58. After the upper electrode 56 is patterned, the piezoelectric body 57 is patterned by the photolithography and the dry etching. It is possible to form the piezoelectric element 77, which is individualized, on the diaphragm 64.

Figure 6B:
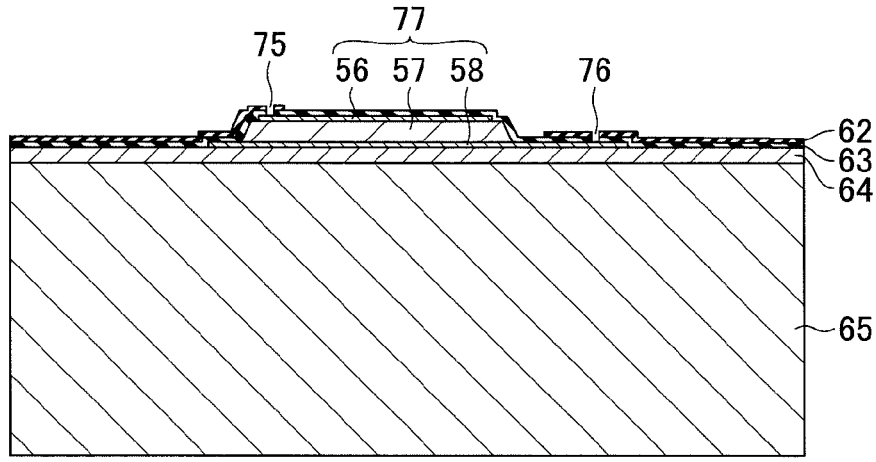

Next, FIG. 6B illustrates a process for forming the insulation films 62 and 63.

The insulation film 63 is an edge protective film of the piezoelectric body 57, and the insulation film 62 is an interlayer insulation film. Dry etching is performed to the insulation film 63 to form an individual electrode contact hole 75 and a common electrode contact hole 76. A contact hole portion and an unnecessary portion of the piezoelectric element 77 are eliminated on the insulation film 62.

By forming the insulation films 62 and 63 on a portion where the ink supply port 59 is formed, it is possible to acquire an effect in which the portion where the ink supply port 59 of the diaphragm 64 is formed is reinforced.

Figure 6C:
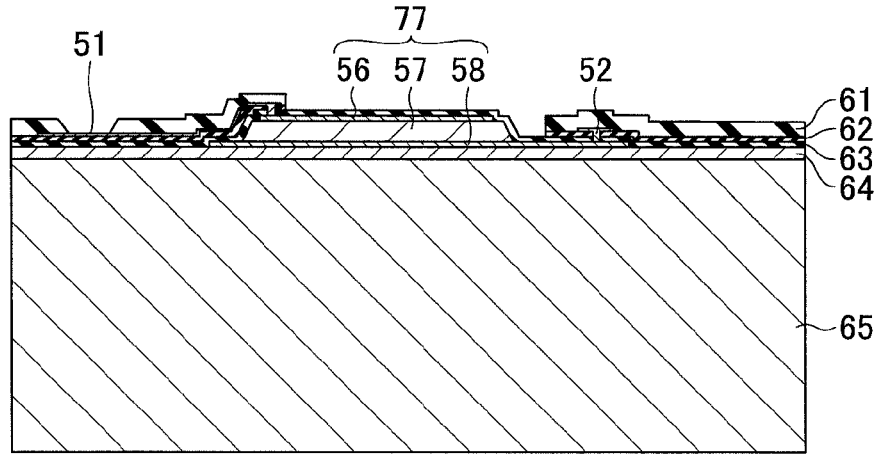

FIG. 6C illustrates a process for patterning the individual wiring electrode 51 and the common electrode wiring 52, and forming the insulation film 61 as a wiring protective film on the wiring.

Areas where the insulation film 61 is eliminated correspond to connection parts for connecting each of the wirings 51 and 52 to the drive circuit (not illustrated), and portions where a portion of the diaphragm 64 for the piezoelectric element 77 and around the piezoelectric element 77 is transformed.

It is possible to use any method for patterning each of the individual wiring electrode 51 and the common electrode wiring 52 and the insulation film 61. It is general to use photolithography and any etching method. Similar to the insulation films 62 and 63, by forming the insulation film 61 on an area where the ink supply port 59, it is possible to assure the strength of a portion peripheral to the ink supply port 59 of the diaphragm 64.

Figure 6D:
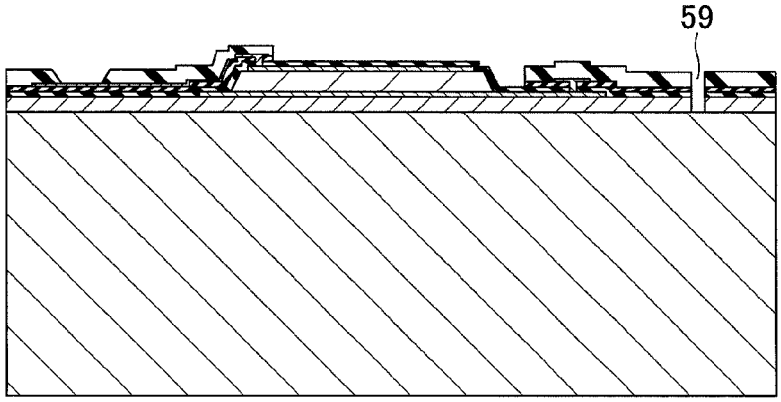

In a process illustrated in FIG. 6D, portions of the insulation films 61, 62, and 63, and the diaphragm 64, which correspond to the ink supply port 59, are eliminated. The ink supply port 59 is patterned by the photolithography and the dry etching. The ink supply port 59 is processed beforehand so that the ink supply port 59 penetrates when the ink supply chamber 53 is processed in a process depicted in FIG. 6F which will be described later. A micro diameter of the ink supply port 59 including the filter function is formed in a fabrication process of parts. In processes after that, it is possible to prevent interfusion of the foreign material into the individual liquid chamber 55, and the like.

Figure 6E:
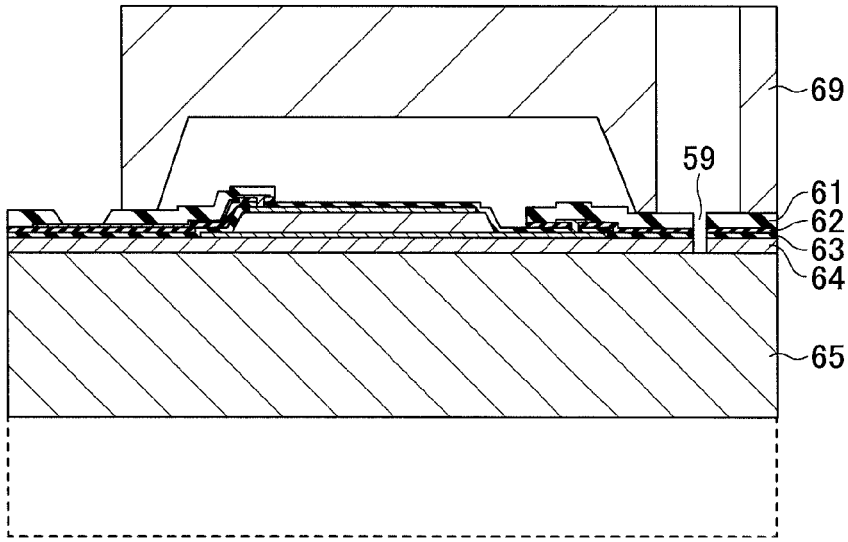

Next, in a process depicted in FIG. 6E, the retention substrate 69 is jointed on the passage substrate 65, and the passage substrate 65 is polished. The thickness after the passage substrate 65 is polished depends on a design of passages including the individual liquid chamber 55, and the individual passage 54. The thickness being equal to or less than 200 μm is preferable. The thickness being equal to or less than 100 μm is further preferable.

When the passage substrate 65 regarded as a Si wafer is polished to be 100 μm in thickness, since the diaphragm 64 and the like are laminated on one side of the passage substrate 65, a curve easily occurs, strength is decreased, and a risk of cracking may be increased. In this case, it is possible to assure the strength of the passage substrate 65 by jointing the retention substrate 69 to the passage substrate 65, and to acquire an effect of reducing an occurrence of the curve.

It is preferable to jointing the retention substrate 69 by coating and pressurizing (and heating if necessary) the adhesion bond in light of the productivity, an ink sealing ability, and the like.

Figure 6F:
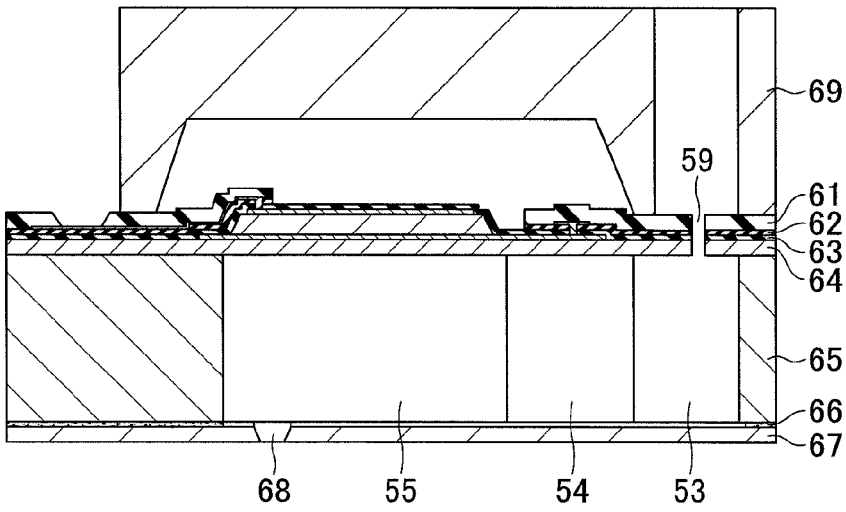

In a process depicted in FIG. 6F, the individual liquid chamber 55 and the like are formed on the passage substrate 65, and the nozzle plate 67 is jointed to the passage substrate 65.

The individual liquid chamber 55 and the like of the passage substrate 65 is formed by photolithography and the Si etching. For the Si etching, an Inductive Coupled Plasma-Reactive Ion Etching (ICP-RIE) etching method using a Bosch process may be preferably used in light of flexibility, and accuracy.

Since a difference of the opening area between the ink supply chamber 53 and the individual liquid chamber 55 is small, the etching rate of the ink supply chamber 53 is close to that of the individual liquid chamber 55 and the individual passage 54, and the overetching of an portion of the ink supply port 59 can be reduced as much as possible. Therefore, after the ink supply port 59 is opened by etching, it is possible to suppress the time to a minimum of exposing the common liquid chamber 70, the ink supply port 59, and the like of the retention substrate 69 to plasma.

Furthermore, it is possible to improve the measurement accuracies of the individual passage 54 and the individual liquid chamber 55 as described above, by reducing an overetching amount.

In subsequent processes which are not depicted in FIG. 6A through FIG. 6F, there is a process in which ink supply system members such as an ink tank and the like are jointed to the ink supply port 59 and signal lines from the drive circuit are jointed to drive circuit connection parts of the individual wiring electrode 51 and the common electrode wiring 52. In a configuration in a related art, the foreign material can be mixed into the ink passages of the individual liquid chamber 55. By forming the ink supply port 59 having the filter function at a stage for parts in the fabrication process, it is possible to prevent the foreign material from being adhered in a subsequent process, and to suppress decreasing of a yield ratio of the fabrication process.

Second Embodiment

Figure 7:
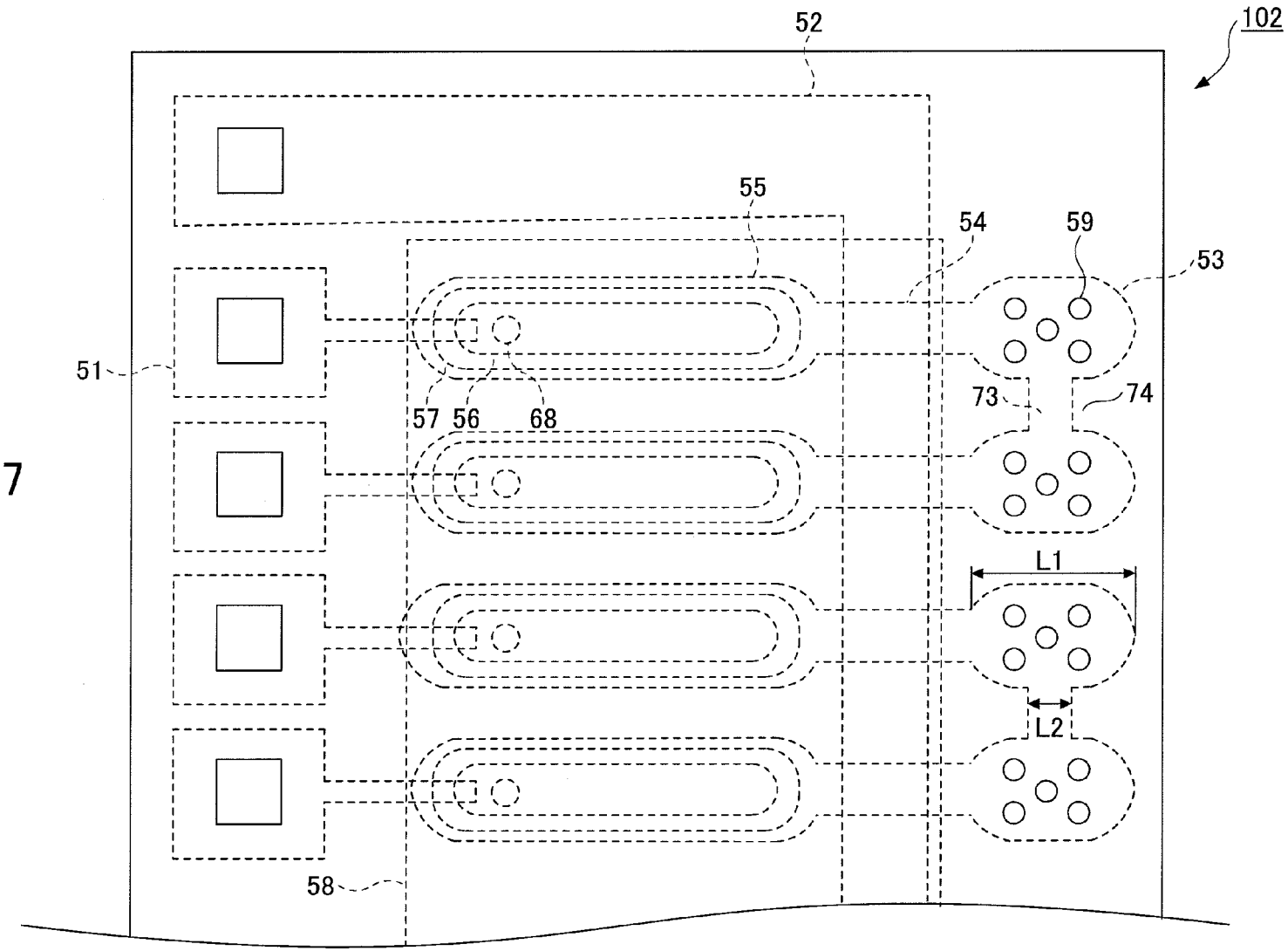
FIG. 7 is a schematic top view of the inkjet head according to a second embodiment.

FIG. 7 illustrates a schematic top view enlarging a part of an inkjet head 102 according to a second embodiment.

Different from the first embodiment, in the inkjet head 102 according to the second embodiment, ink passages 73 are formed at portions of the bulkhead 74 for compartmenting each of the ink supply chambers 53.

By providing the bulkhead 74 for compartmenting each of the ink supply chambers 53, the inkjet head 102 assures the strength of the diaphragm 64 at a part peripheral to the ink supply port 59. In the second embodiment, while the strength of the diaphragm 64 from the bulkhead 74 is retained, the ink passage 73 is provided at one of the bulkheads 74 between the ink supply chamber 53 and an other ink supply chamber 53 adjacent thereto.

The ink passage 73 provided to the bulkhead 74 of the ink supply chamber 53 may be provided in a range in which the strength of the diaphragm 64 is reduced. As illustrated in FIG. 7, width L2 of the ink passage 73 is made to be ½ width of L1 of the ink supply chamber 53, and one location is preferable for one bulkhead 74.

By this configuration, even if a part of the ink supply port 59 is clogged by the foreign material and the like included in the ink, the ink can be supplied from the adjacent ink supply chamber 53. Thus, it is possible to improve resistance to clogging with respect to the foreign material and the like included in the ink.

Third Embodiment

Figure 8:
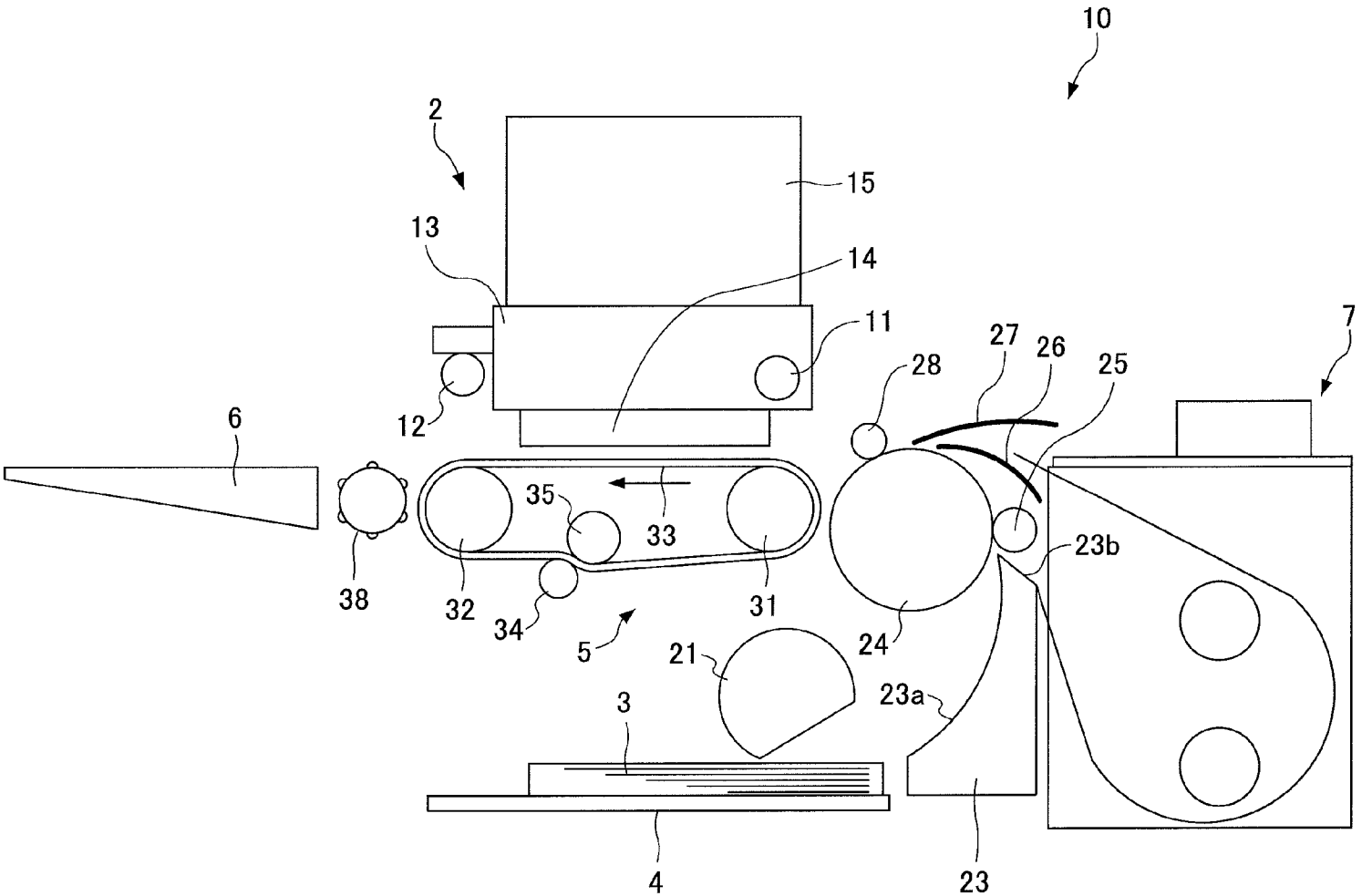
FIG. 8 is a schematic diagram illustrating an configuration of an inkjet recording device according to a third embodiment.

FIG. 8 is a schematic diagram illustrating a configuration of an inkjet recording device 10 according to a third embodiment.

The inkjet recording device 10 takes in a sheet 3 to be supplied from a paper feed tray 4. After the inkjet recording device 10 records an image by an image formation part 2 while conveying the sheet 3, the sheet 3 is ejected to an ejection tray 6.

Also, the inkjet recording device 10 includes a double-sided unit 7 which is detachably provided. When a double-sided print is carried out, after one side (face side) is printed, the sheet 3 is conveyed in an inverse direction by a conveyance mechanism 5 and is fed into the double-sided unit 7. The sheet 3 is inversed so that another side (back side) is set as a side to be printed. After the other side (back side) is printed, the sheet 3 is ejected to the ejection tray 6.

The image formation part 2 slidably retains a carriage 13 at guide shafts 11 and 12. The carriage 13 is moved in a direction perpendicular to a carriage direction of the sheet 3 by a main scan motor (not depicted) (main scan).

The carriage 13 mounts an inkjet head 14 in which nozzle openings, being multiple discharge openings, are arranged to discharge droplets. The carriage 13 mounts detachably an ink cartridge 15, which supplies liquid, to the inkjet head 14.

Also, instead of the ink cartridge 15, the carriage 13 may mount a head tank. In this configuration, the ink is replenished from the main tank to the head tank.

The inkjet head 14 is formed as a droplet discharge head which discharges an ink droplet of each color of yellow, magenta, cyan, and black. Alternatively, one or multiple heads including multiple nozzle lines for discharging the ink droplet of each color may be used. It is noted that the number of colors and an arrangement order are not limited to this configuration.

The inkjet head 14 is formed in a similar configuration to the first embodiment or the second embodiment. The nozzle is not easily clogged. Thus, the inkjet head 14 can be used for the long term due to its high strength.

The sheet 3 of the paper feed tray 4 is separated one by one by a separation pad (not depicted), is fed into a device body, and is conveyed to the conveyance mechanism 5.

The conveyance mechanism 5 includes a conveyance guide part 23 which guides the sheet 3 being conveyed upward in accordance with a guide surface 23*a*, and guides the sheet 3 being sent from the double-sided unit 7 in accordance with the guide surface 23*b*. Also, the conveyance mechanism 5 includes a conveyance roller 24 which conveys the sheet 3, a pressure roller 25 which presses the sheet 3 with respect to the conveyance roller 24, guide members 26 and 27, a pressing roller 28 which presses the sheet 3 being sent from the conveyance roller 24.

Furthermore, the conveyance mechanism 5 includes a conveyance belt 33 which bridges between a drive roller 31 and a driven roller 32, a charging roller 34 which charges the conveyance belt 33, and a guide roller 35 opposed to the charging roller 34, in order to convey the sheet 3 with retained planarity of the sheet 3 at the inkjet head 14. Moreover, the conveyance mechanism 5 includes a guide member which guides the conveyance belt 33 at a portion opposed to the image formation part 2, a cleaning roller which is formed by a porous body and the like used as a cleaning part for eliminating the ink adhered to the conveyance belt 33, and the like, which are not depicted.

The conveyance belt 33 is an endless belt, and is hung on the drive roller 31 and the driven roller 32. The conveyance belt 33 is formed to go around in a direction indicated by an arrow (sheet conveyance direction).

The conveyance belt 33 may be formed to be a single layer configuration, a two-layer configuration, or a configuration of more than two layers. For example, the conveyance belt 33 may be formed by resin material having pure thickness of approximately 40 μm in which a resistance control is not performed. That is, for example, the conveyance belt 33 may be formed by a surface layer regarded as a sheet absorption surface formed by an ethylene tetrafluoroethylene (ETFE) pure material, and a rear surface (an intermediate resistance layer and a ground layer) formed by the same material as that of the surface layer in which the resistance control is performed by carbon.

The charging roller 34 contacts the surface layer of the conveyance belt 33, and is arranged so as to rotate by being driven by the conveyance belt 33. High voltage is applied with a predetermined pattern to the charging roller 34 from a high voltage circuit (high voltage power supply) (not depicted).

At a downstream side of the conveyance mechanism 5, an ejection roller 38 is provided to send out the sheet 3, on which an image is recorded, to the ejection tray 6.

The conveyance belt 33 goes around in the direction indicated by the arrow, and is positively charged by contacting the charging roller 34 to which high voltage is applied. In this case, the charging roller 34 charges the conveyance belt 33 at a predetermined charging pitch by switching polarity at a predetermined time interval.

When the sheet 3 is fed onto the conveyance belt 33 being charged by the high voltage, inside the sheet 3 becomes a polarization state, and a charge having reverse polarity to a charge on the conveyance belt 33 is brought to a surface of the sheet 3 contacted to the conveyance belt 33. The charge on the conveyance belt 33 and the charge brought onto the sheet 3 being conveyed electrically pull at each other, and the sheet 3 is electrostatically attracted to the conveyance belt 33. For the sheet 3 being drawn, a curve, and concavity and convexity are corrected, and a flat and smooth surface is formed. The sheet 3 drawn to the conveyance belt 33 is conveyed to the image formation part 2.

While the sheet 3 passes the image formation part 2, the inkjet head 14 is driven in response to an image signal by moving and scanning the carriage 13 in one direction or both directions, and discharges ink droplets from the nozzles. Dots are formed by adhering the droplets on the sheet 3 being stopped. After one line is recorded on the sheet 3, the sheet 3 is conveyed by a predetermined conveyance amount, and a next line is recorded.

When a record end signal or a signal, which indicates that a rear edge of the sheet 3 arrives at a record area, a recording operation ends.

The sheet 3, on which the image is recorded by passing the above-described processes, is ejected to the ejection tray 6 by the ejection roller 38.

In the inkjet recording device 10, the inkjet head 100 in the first embodiment or the inkjet head 102 in the second embodiment is provided. Thus, the inkjet recording device 10 has a configuration in which an occurrence of clogging of the nozzles caused by the foreign material is reduced and which indicates superior strength. By including the inkjet head 100 or 102, it is possible for the inkjet recording device 10 to form the image of high resolution stably for a longer term.

Comparison Example

Figure 5:
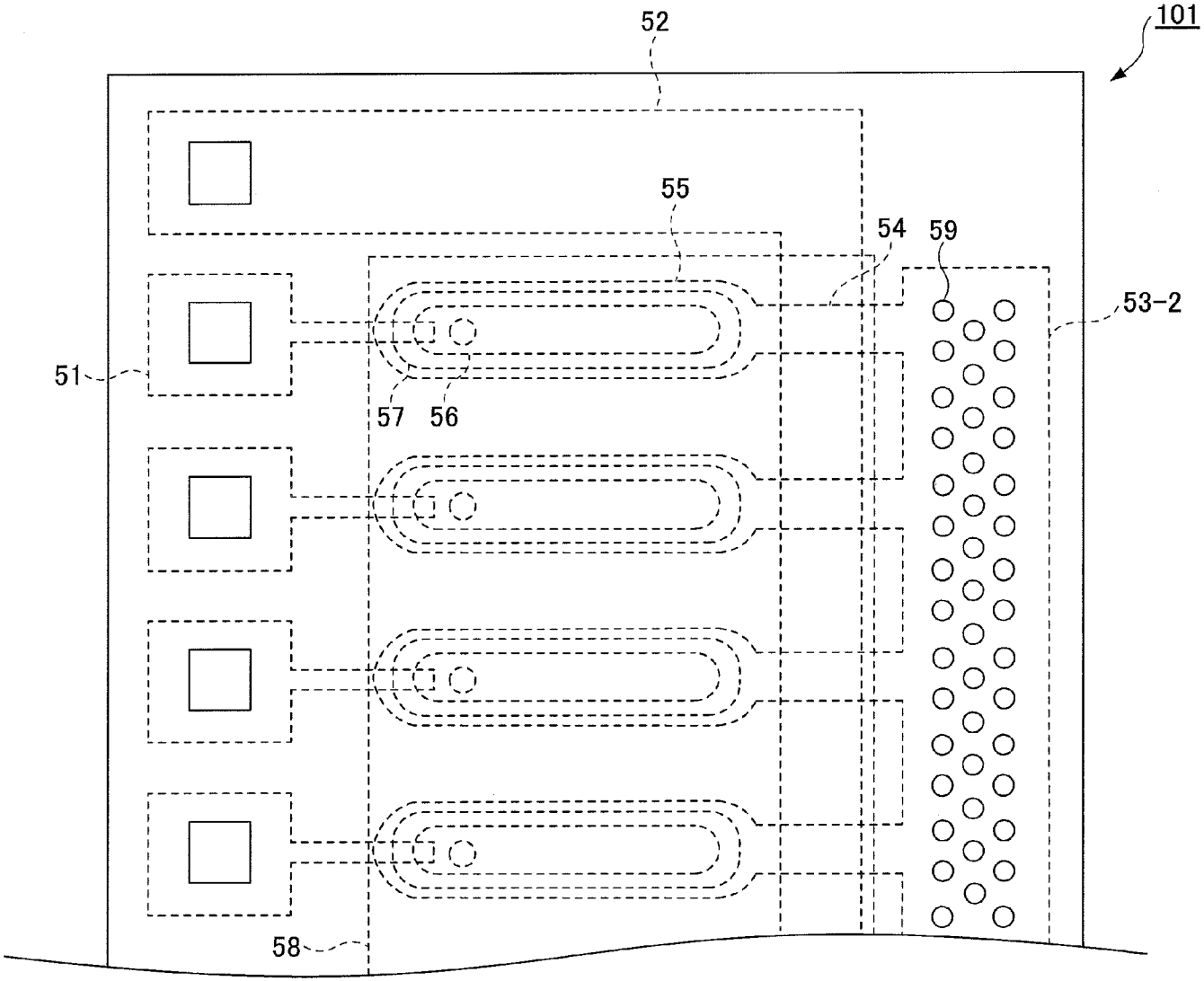
FIG. 5 is a schematic top view of an inkjet head according to a comparison example.

FIG. 5 illustrates a schematic top view enlarging a part of an inkjet head 101 according to a comparison example.

In the inkjet head 101, the individual liquid chamber 55 and the individual passage 54 are formed for each of the nozzles. However, an ink supply chamber 53-2 is not compartmented by a bulkhead, and is lead to the plurality of individual passages 54.

In the above-described configuration, the opening area of the ink supply chamber 53-2 on the passage substrate 65 is larger. Thus, the strength of a portion where the ink supply port 59 joins the diaphragm 64 becomes insufficient, and a possibility of an occurrence of cracking and the like may be higher.

Moreover, the opening area of the ink supply chamber 53-2 is greatly different from those of the individual liquid chamber 55 and the individual passage 54, and the etching rate of etching the passage substrate 65 is different depending on each of the portions. Thus, since the overetching time partially becomes longer, the measurement accuracies of the passage substrate 65, the individual liquid chamber 55, and the like are degraded.

The inkjet head 101 according to the comparison example has a configuration in which the ink supply chamber 53-2 is not compartmented by the bulkhead. It is not possible to assure the strength of portions where the ink supply ports 59 join the diaphragm 64, and to guarantee process accuracy of etching the passage substrate 65.

SUMMARY

As described above, according to the first, second, and third embodiments, the ink supply ports 59 are formed at a stage of the parts in the fabrication process. It is possible to prevent the foreign material from adhering inside the ink passage in the subsequent processes, and to effectively prevent the occurrence of clogging even in a case of micronizing the nozzle 68. Moreover, the ink supply ports 59 have a filter function. Thus, it is possible to filter the foreign material, such as an aggregate and the like, included in the ink, and to prevent the foreign material from interfusing into the ink passage. Furthermore, according to the first, second, and third embodiments, it is possible to form the ink supply ports 59 having the filter function without an increase of the fabrication costs.

By compartmenting each of the ink supply chambers 53 from other ink supply chambers 53 by the bulkhead 74, it is possible to compensate the strength of the portions where the ink supply ports 59 join the diaphragm 64. Moreover, it is possible to make the difference between the opening area of the individual passage 54 and the ink supply chamber 53 smaller. Thus, it is possible to reduce overetching in the fabrication process of the passage substrate 65, and to realize a highly precise process.

According to the present invention, high resistance to the foreign material is realized, and a configuration superior in strength is realized. Thus, it is possible to stably perform image formation for a longer term. Moreover, it is possible for the inkjet recording device including the inkjet head to stably perform the image formation of a higher resolution.

According to the present invention, the filter having a fine structure is formed in the fabrication process of the parts without increasing the fabrication costs. It is possible to prevent an occurrence of clogging of the foreign material in a case of micronizing a nozzle diameter. In addition, it is possible to provide the inkjet head and the inkjet recording device which have sufficient strength to prevent occurrences of cracking and the like.

The multiple ink supply ports 59, which function as the filter, are formed between ink supply chambers 53 (liquid supply chamber) leading to the nozzle 68 and the common liquid chamber 70 in the fabrication process of the parts. There is no space for the foreign material to enter the ink passage in the fabrication process, and it is possible to eliminate foreign material included in the ink by the filter function. Accordingly, the clogging of the nozzle 68 due to foreign material and the like can be prevented, and an occurrence of discharge defects can be suppressed. It is possible to contribute to an image formation of higher quality.

Also, by compartmenting each of the liquid supply chambers by the bulkhead, occurrences of deformation or damage of portions of the diaphragm 64 where the ink supply ports 59 are formed can be suppressed, and sufficient strength can be acquired. Accordingly, it is possible to provide an inkjet head which can be used for a long time and retain the image quality.

Moreover, the present invention is not limited to the configurations in the first through third embodiments described above, including combinations with other elements. In this viewpoint, variations and modifications may be made without departing from the scope of the invention, and may be properly defined depending on its application aspect.

The present application is based on Japanese Priority Patent Application No. 2011-134828 filed on Jun. 17, 2011, the entire contents of which are hereby incorporated by reference.

What is claimed is:

1. An inkjet head, comprising:

a nozzle plate configured to form multiple nozzles for discharging ink;

a passage substrate configured to be jointed to the nozzle plate, and in which an individual liquid chamber leading to a nozzle, and a liquid supply chamber connected to the individual liquid chamber through an individual passage are formed for each of the multiple nozzles; and a diaphragm configured to form a piezoelectric element which is laminated on a side opposite to the nozzle plate of the passage substrate and includes a lower electrode, a piezoelectric body, and an upper electrode, wherein the liquid supply chamber formed for each of the multiple nozzles is compartmented by a bulkhead from an other liquid supply chamber, and each of the liquid supply chamber and the other liquid supply chamber includes multiple ink supply ports, and wherein an ink passage is provided at the bulkhead between the liquid supply chamber and the other liquid supply chamber adjacent to the liquid supply chamber.

2. The inkjet head as claimed in claim 1, wherein opening areas of the multiple ink supply ports are smaller than opening areas of the multiple nozzles.

3. The inkjet head as claimed in claim 1, wherein a laminated film is formed by an insulator at portions corresponding to the individual liquid chamber and the liquid supply chamber of the diaphragm.

4. The inkjet head as claimed in claim 3, the diaphragm and the laminated film includes at least one of silicon oxide and silicon nitride.

5. An inkjet head, comprising:

a nozzle plate configured to form multiple nozzles for discharging a passage substrate configured to be jointed to the nozzle plate, and in which an individual liquid chamber leading to a nozzle, and a liquid supply chamber connected to the individual liquid chamber through an individual passage are formed for each of the multiple nozzles; and a diaphragm configured to form a piezoelectric element which is laminated on a side opposite to the nozzle plate of the passage substrate and includes a lower electrode, a piezoelectric body, and an upper electrode, wherein the liquid supply chamber formed for each of the multiple nozzles is compartmented by a bulkhead from an other liquid supply chamber, and each of the liquid supply chamber and the other liquid supply chamber includes multiple ink supply ports, and wherein a retention substrate, which forms a common liquid chamber for supplying ink to the liquid supply chamber, is jointed at a side of diaphragm of the passage substrate; and the common liquid chamber communicates with a plurality of individual liquid chambers of the passage substrate through the ink supply ports.

6. An inkjet head recording device which includes an inkjet head comprising:

a nozzle plate configured to form multiple nozzles for discharging ink;

a passage substrate configured to be jointed to the nozzle plate, and in which an individual liquid chamber leading to a nozzle, and a liquid supply chamber connected to the individual liquid chamber through an individual passage are formed for each of the multiple nozzles; and a diaphragm configured to form a piezoelectric element which is laminated on a side opposite to the nozzle plate of the passage substrate and includes a lower electrode, a piezoelectric body, and an upper electrode, wherein the liquid supply chamber formed for each of the multiple nozzles is compartmented by a bulkhead from an other liquid supply chamber, and each of the liquid supply chamber and the other liquid supply chamber includes multiple ink supply ports, and wherein an ink passage is provided at the bulkhead between the liquid supply chamber and the other liquid supply chamber adjacent to the liquid supply chamber.

* * * * *